US006431464B2

(12) United States Patent
Seitz

(10) Patent No.: US 6,431,464 B2
(45) Date of Patent: Aug. 13, 2002

(54) THERMAL SPRAYING METHOD AND APPARATUS

(75) Inventor: Michael Walter Seitz, Roodepoort (ZA)

(73) Assignee: Metalspray U.S.A., Inc., Richmond, VA (US)

( * ) Notice: Subject to any disclaimer, the term of this patent is extended or adjusted under 35 U.S.C. 154(b) by 0 days.

(21) Appl. No.: 09/899,936

(22) Filed: Jul. 9, 2001

Related U.S. Application Data

(63) Continuation of application No. 09/214,097, filed as application No. PCT/GB97/01723 on Dec. 28, 1996, now Pat. No. 6,258,416.

(30) Foreign Application Priority Data

Jun. 28, 1996 (ZA) ..... 96/5518
Jun. 28, 1996 (ZA) ..... 96/5519

(51) Int. Cl.[7] ..... B05B 1/24
(52) U.S. Cl. ..... 239/80; 239/83; 219/76.14
(58) Field of Search ..... 239/79–81, 83, 239/84; 219/76.14

(56) References Cited

U.S. PATENT DOCUMENTS

| | | | | |
|---|---|---|---|---|
| 2,749,176 A | * | 6/1956 | Steyer | |
| 3,901,441 A | * | 8/1975 | Kasagi | 239/81 X |
| 4,464,414 A | | 8/1984 | Milewski et al. | |
| 5,046,944 A | | 9/1991 | Smith | |
| 5,109,150 A | | 4/1992 | Rogers | |
| 5,191,186 A | | 3/1993 | Crapo, III et al. | |
| 5,213,848 A | | 5/1993 | Zurecki et al. | |
| 5,296,667 A | | 3/1994 | Marantz et al. | |
| 5,468,295 A | | 11/1995 | Marantz et al. | |
| 5,528,010 A | | 6/1996 | Herwig et al. | |
| 5,932,293 A | | 8/1999 | Belashchenko et al. | |
| 5,964,405 A | * | 10/1999 | Benary et al. | 239/84 |
| 6,245,390 B1 | * | 6/2001 | Baranovski et al. | 239/79 X |

FOREIGN PATENT DOCUMENTS

| | | | |
|---|---|---|---|
| CH | 213 068 C | | 1/1941 |
| DE | 27 46 714 A | | 4/1979 |
| DE | 43 39 345 A | | 5/1995 |
| EP | A-0 051 869 | | 5/1982 |
| EP | A-0 156 760 | | 6/1990 |
| EP | 0 445 538 A | | 9/1991 |
| EP | 492 422 | | 7/1992 |
| EP | 0 522 438 A | | 1/1993 |
| FR | 21 107 324 | | 4/1972 |
| JP | 61-73871 | * | 4/1986 |
| WO | WO 97/36692 | | 10/1997 |

OTHER PUBLICATIONS

Thermal Spraying: Practice, Theory, and Application, American Welding Society, Inc. pp. 108–109, 1985.

Patent Abstracts of Japan, vol. 7, No. 100 (C–164)[1245], Apr. 28, 1983 & JP–A–58 27 971 (Hitachi Seisakusho) Feb. 18, 1983.

JP 51 141 736 A (Kawasaki Heavy Ind), Dec. 5, 1976.

International Search Report for PCT application PCT/GB97/01723 (priority application).

* cited by examiner

*Primary Examiner*—Lesley D. Morris
(74) *Attorney, Agent, or Firm*—McDermott, Will & Emery

(57) ABSTRACT

A thermal spraying method involves the creation of a coating comprising titanium wire in the presence of nitrogen. The apparatus of the invention comprises a nozzle which has a cylindrical throat, with feedstock guides which guide the feedstock wires to a point of intersection in the throat. A current is passed through the wires to cause an arc in the throat, and a nitrogen rich gas under pressure is forced through the throat, generating a spray of molten particles which is used to coat a substrate. In a variation of the method, one of the feedstock wires comprises a binder metal, which produces a coating having enhanced toughness.

17 Claims, 2 Drawing Sheets

THERMAL SPRAYING METHOD AND APPARATUS

CROSS REFERENCE TO RELATED APPLICATIONS

The application is a continuation of application Ser. No. 09/214,097, filed Dec. 28, 1998, now U.S. Pat. No. 6,258,416 B1 , issued Jul. 10, 2001, which is a 371 of PCT/GB97/01723, filed Jun. 27, 1997, which claims priority from patent application Nos. 96/5518 and 96/5519, filed in South Africa on Jun. 28, 1996.

THIS invention relates to a thermal spraying method for producing a hard coating on a substrate, and to thermal spraying apparatus which can be used for producing metallic or cermet coatings on a substrate.

BACKGROUND

Arc metal spraying is used in industry to produce coatings on substrates by generating an arc between feedstock electrodes. The molten feedstock is divided into small particles of molten material by an atomising gas jet. These molten particles are propelled by the gas jet onto the substrate to be coated. The fineness of the particles is determined, inter alia, by the velocity of the atomising gas jet.

SUMMARY OF THE INVENTION

It is an object of the invention to provide a thermal spraying method which can be used to produce hard coatings with desirable properties, and an alternative thermal spraying apparatus.

According to a first aspect of the invention a method of forming a coating on a substrate comprises the steps of:

providing a feedstock material containing titanium;

atomising the feedstock material in the presence of nitrogen; and spraying the atomised material onto a substrate to form a coating comprising titanium nitride on the substrate.

The coating may additionally comprise oxides and carbides of titanium.

The feedstock material is preferably atomised by generating an arc between at least two feedstock elements.

Preferably, at least one of the feedstock elements is a titanium wire which is fed towards a point of intersection between the feedstock elements where the arc is generated.

The point of intersection is preferably located within a throat of a nozzle, the method including supplying a nitrogen rich gas under pressure to the throat of the nozzle to assist in expulsion of atomised particles therefrom.

The gas is preferably supplied to the throat of the nozzle at a pressure sufficient to generate choked gas flow in the throat.

The gas will typically be air.

At least one of the feedstock elements may be a wire comprising a metal selected to have suitable properties as a binder of the titanium nitride in the coating, such as nickel.

According to a second aspect of the invention there is provided thermal spraying apparatus comprising:

a nozzle defining a throat having an inlet and an outlet;

at least first and second guides arranged to guide respective feedstock wires via the inlet towards a point of intersection in the throat, so that connection of the wires to a power supply causes an arc in the throat between the wires, creating molten particles which are expelled from the outlet.

The throat may comprise a tubular bore which substantially surrounds the point of intersection of the two feedstock wires.

The diameter of the throat is preferably substantially constant along its length.

The length of the throat is preferably approximately equal to its diameter.

Preferably, the point of intersection is between a point located about midway along the length of the throat and the outer end of the throat.

The nozzle preferably defines a gas flow path which is aligned with the axis of the throat, so that gas under pressure can be supplied to the inlet between the feedstock wires to assist in expulsion of molten particles from the outlet.

The nozzle may define a chamber inwardly of the throat, the chamber having an inner wall which has an average internal diameter several times greater than that of the throat and which tapers inwardly towards an inner end of the throat.

The inner wall of the chamber preferably joins the inner end of the throat at an angle of approximately 45°.

DESCRIPTION OF THE INVENTION

In the method of the present invention, a high velocity thermal spray gun is used to atomise a feedstock material containing titanium in the presence of nitrogen to obtain particles comprising titanium nitride, which are then sprayed onto a substrate to be coated.

The apparatus of the invention forms part of a spray gun of this kind, which utilises two or more feedstock wires which are fed through suitable guides towards a point of intersection. A suitably high electrical current is passed through the wires, creating an arc at the point of intersection. An air jet atomises the feedstock material, which is then sprayed onto a substrate.

In a conventional spray gun of this kind, the feedstock wires are fed through a nozzle, so that their point of intersection is beyond the end of the nozzle. An atomising air jet emitted by the nozzle carries the molten particles towards the substrate in a jet.

In the present invention, the point of intersection of the feedstock wires is within the throat of the nozzle, rather than outside the nozzle. The creation of an arc in the throat has the effect of generating supersonic flow in the nozzle, which would otherwise not be attainable. This very high flow velocity results in very fine atomisation of the molten feedstock particles, and very high particle speeds as the particles are emitted towards the substrate.

Figure 1:
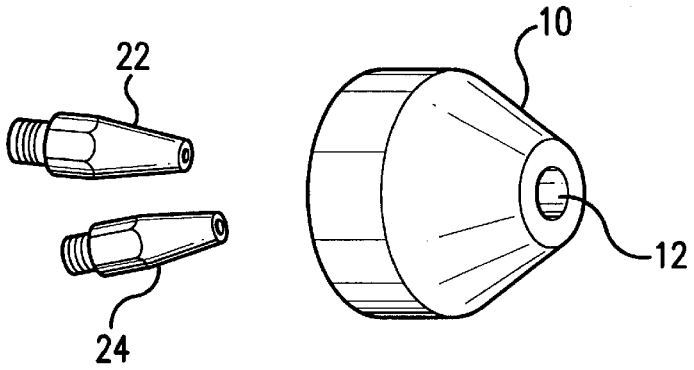
FIG. 1 is an exploded pictorial view of the front portion of a spray gun according to the invention.
Figure 2:
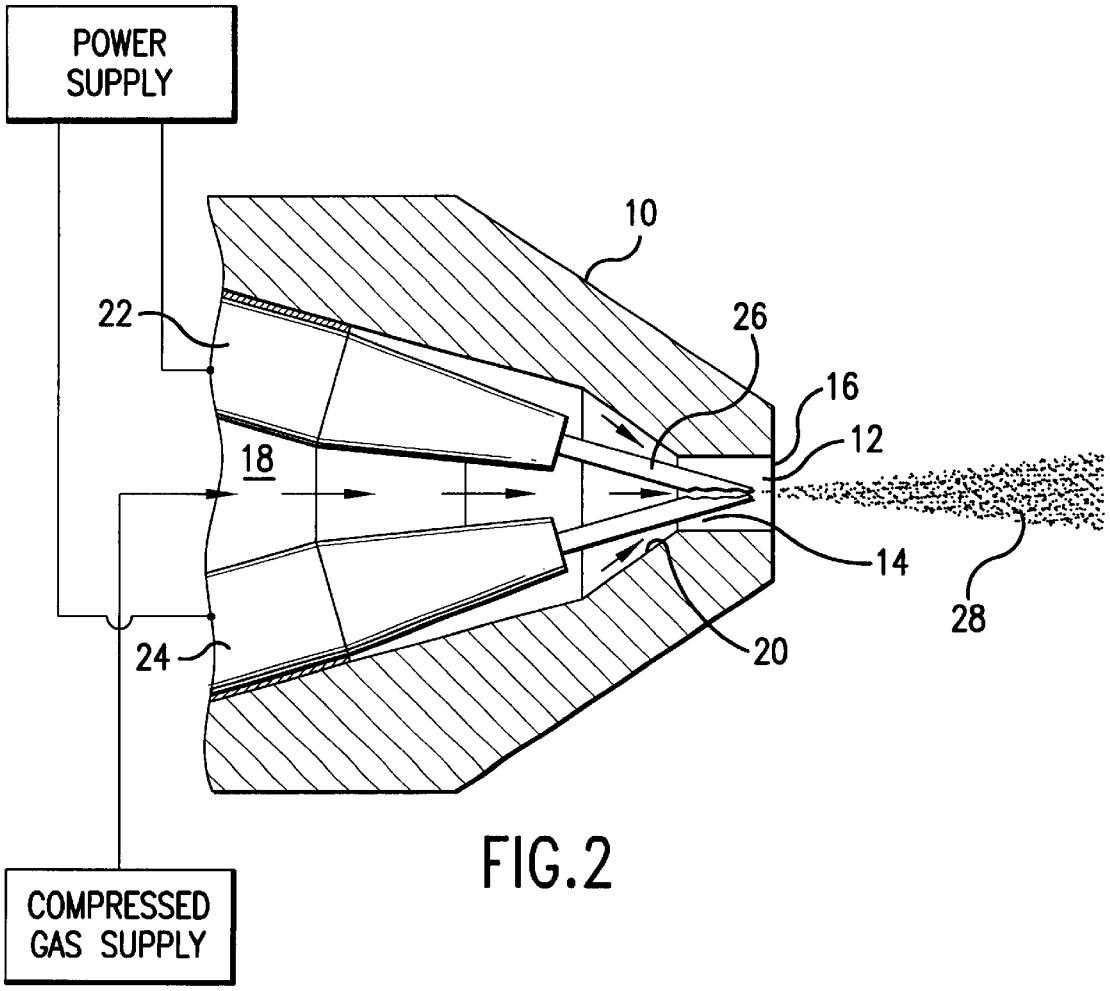
FIG. 2 is a sectional side view of the nozzle of the spray gun.

Referring now to FIGS. 1 and 2, a high velocity spray gun according to the invention comprises a nozzle 10 which defines a throat 12 in the form of a tubular bore having an inlet 14 and an outlet 16. In the prototype apparatus, the length and diameter of the throat were approximately equal at 8 mm, with the diameter of the throat being constant along its length.

The interior of the nozzle defines a chamber 18 which has an average internal diameter several times greater than that of the throat 12 and which is generally frusto-conical in shape. At the end of the chamber adjacent the inlet 14 of the throat 12, the inner wall 20 of the chamber is tapered inwardly more sharply, and joins the inner end of the throat at an angle of approximately 45°.

The interior of the nozzle receives a pair of feedstock guides 22 and 24 which are inclined towards one another and which are disposed adjacent the inner surface of the chamber 18.

Wire feedstock material 26 (titanium wire in the basic method of the invention) is fed longitudinally thorough the guides 22 and 24 by a wire feeder mechanism (not shown), so that the two wires converge towards a point of intersection located on the axis of the throat 12 of the nozzle, between a point approximately midway along the length of the throat and the outer end of the throat. The dimensions of the throat are selected to permit an arc between the two feedstock wires to be located substantially within the throat 12.

In FIG. 1, the included angle between the feedstock guides is about 30°, but a greater angle, say 60°, leads to a smaller effective point of intersection between the feedstock wires, which is desirable.

In operation, air (or another nitrogen-rich gas) is forced into the spray gun head under pressure, with the pressure and volume being adjusted so that the gas flow within the throat 12 is sonic (i.e. choked) or very close to being choked. Current is applied to the feedstock wires to create an electric arc between them, so that the air or gas being forced through the throat of the nozzle is heated substantially instantaneously to 4000° C.–5000° C. by the arc. This rapid heating of the gas accelerates it to very high velocities, expelling the air and molten feedstock particles from the outlet 16 in a fine jet 28.

In a prototype of the apparatus, a voltage of 35 V was applied between the feedstock wires from a constant voltage source, creating an arc current in the region of 180A to 200A. The feed rate of the feedstock wires was about 3 m/min. A supply of compressed air with a pressure of 600 kPa was used, providing a gas pressure in the chamber 18 of approximately 400 kPa. The choked pressure in the throat 12 was approximately 200 kPa with the throat shape and dimensions given above.

The feedstock wires have a composition which is selected to create a coating having desired chemical and physical characteristics. For example, a 1.6 mm diameter wire of 316 stainless steel can be used as a feedstock to produce a coating of stainless steel on a substrate.

Due to the high velocity of the jet, the particles are very finely atomised, improving the properties of the coating. Also due to the high velocity of the jet, the jet is well focused and the deposit it generates is very dense.

Figure 3A:
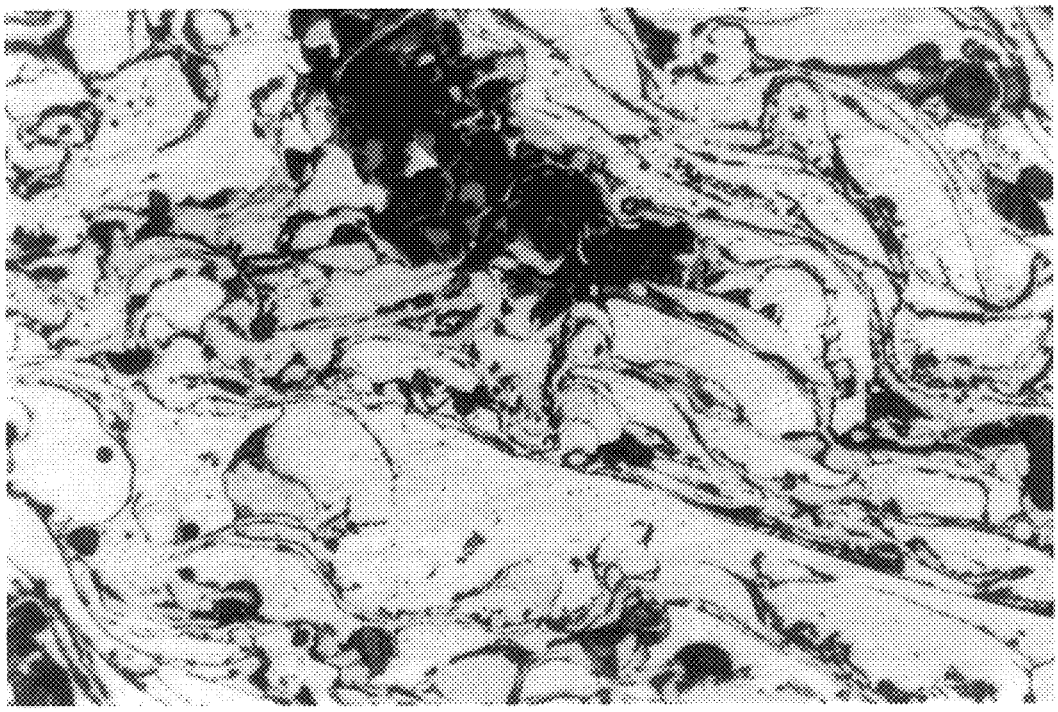
FIGS. 3*a* and 3*b* are photographs of coatings produced by a prior art arc spray gun and the apparatus of the invention, respectively.
Figure 3B:
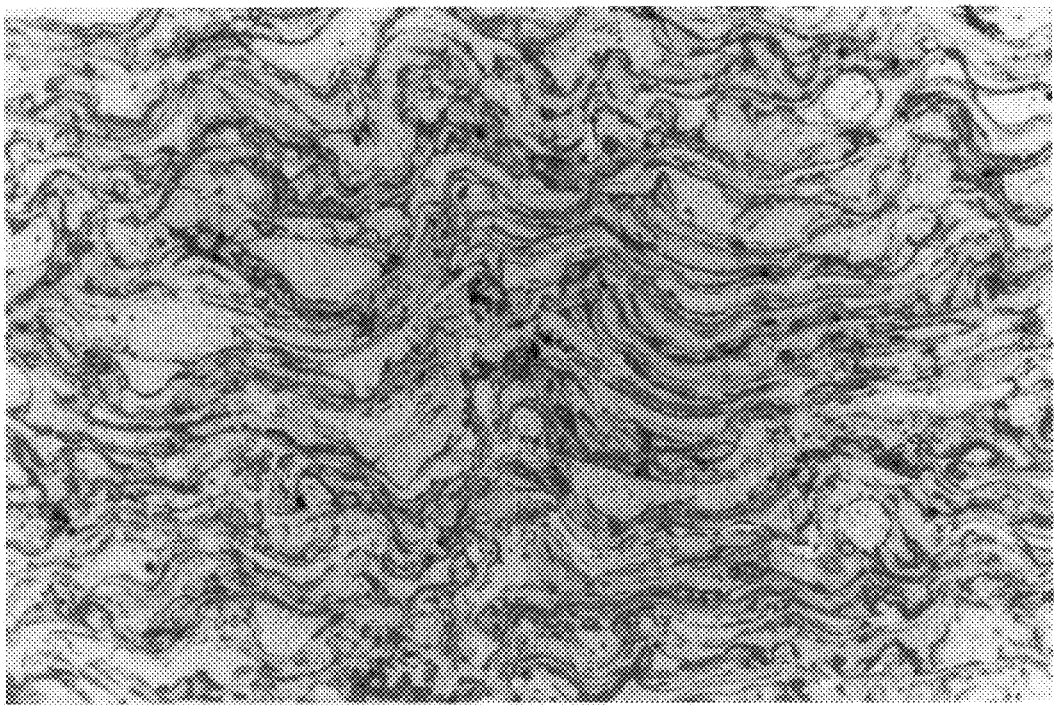

FIGS. 3*a* and 3*b* illustrate the difference between coatings produced by a conventional arc spray gun and the above described apparatus of the invention, respectively. The texture of the coating produced by the prior art apparatus is relatively coarse, whereas that produced by the apparatus of the present invention is much finer and less porous.

Where titanium is used as a feedstock material, it is believed that the arc has the effect of ionising the nitrogen (and other elements) in the air passing through the throat of the nozzle, causing a reaction to take place between the nitrogen ions and the molten titanium metal particles. This results in a high proportion of the titanium metal reacting with the nitrogen to form titanium nitride. In addition, titanium oxide and titanium carbide can be expected to be formed. Due to the fine atomisation produced by the spray gun, a relatively large percentage of the atomised titanium metal reacts with the nitrogen, with a resulting large percentage of titanium nitride in the deposited material.

Coatings formed by the method were found to contain approximately 2% to 5% percent of the original titanium metal, which acts as a binder for the particles of titanium nitride and makes the coating tougher and less brittle. Tests showed that the coatings were very hard, with a Vickers hardness of approximately Hv 1100.

The typical stoichiometery of the coatings referred to above is $Ti_{1.0}N_{0.94}O_{0.08}$, which is a titanium nitride compound comprising a small proportion of oxygen.

In order to increase the toughness of the coating formed by the method of the invention, while retaining the properties of the extremely hard titanium nitride, a metal selected for its properties as a binder can be incorporated in the coating. This conveniently achieved by replacing one of the titanium feedstock wires with a wire of the selected binder metal, for example nickel. The binder metal is then mixed by the arc spray process with the titanium nitride deposit, producing a composite deposit containing, say, 48% titanium nitride and the balance comprising the metal, which acts as a binder in the titanium nitride matrix. The two feedstock wires need not be of exactly the same diameter, thus permitting the percentage of metal binder to titanium nitride to be varied according to the requirements of the particular application.

A particular advantage of the method of the invention is that it allows the creation of substantially thicker coatings than prior art methods. Coatings of 0.5 mm thickness or greater are possible. Because titanium nitride is chemically inert, the method of the invention is particularly useful in coating substrates which will be subjected to corrosive or erosive environments, such as propeller or turbine blades. It is also envisaged that the method will be useful in coating medical implants, due to the chemical inertness and biocompatibility of titanium nitride. The coatings produced by the method also have an attractive golden colour.

It was found that, when viewed under high magnification, a large number of very small shrinkage cracks (of the order of 0.5 $\mu$m) were exhibited within each spray particle in the deposit or coating. In order to improve the corrosion protection properties of the coating, a sealer such as a phenolic resin sealer can be applied, for example by painting, to the coating after spraying. The application of a thin sealant layer onto a titanium nitride coating is particularly effective, as the micro-cracks are extensive and well distributed and the sealer is thus effectively soaked into the coating, sealing it. Since the sealer is then contained within the coating matrix, the sealer is protected within the coating from mechanical damage, thus ensuring that it is effective for an extended period of time.

What is claimed is:

1. A thermal spraying apparatus comprising:

a nozzle defining a throat including an inlet, an outlet and a gas low path which is aligned with the axis of the throat so that gas under pressure can be supplied to the inlet;

at least first and second guides arranged to guide respective feedstock wire elements via the inlet of the throat towards a point of intersection in the throat;

a power supply arranged to be connected to the feedstock elements to cause an arc in the throat between the elements; and a supply of compressed nitrogen rich gas at a pressure sufficient to cause choked gas flow in the throat, so that, in use the choked gas flow in the throat is accelerated due to rapid heating by the arc of the gas in the throat, to generate a supersonic gas flow leaving the nozzle with a spray of finely atomized particles entrained therein.

2. Thermal spraying apparatus according to claim 1, wherein the pressure of the compressed nitrogen rich gas is sufficient to generate a choked pressure in the throat of approximately 200 kPa.

3. Thermal spraying apparatus according to claim 1, wherein the power supply generates an arc current in the region of 180 Åto 200 Å.

4. Thermal spraying apparatus according to claim 2, wherein the power supply generates an arc current in the region of 180 Åto 200 Å.

5. Thermal spraying apparatus according to claim 1, wherein the throat comprises a tubular bore which substantially surrounds the point of intersection of the two feedstock wire-like materials.

6. Thermal spraying apparatus according to claim 2, wherein the throat comprises a tubular bore which substantially surrounds the point of intersection of the two feedstock wire-like materials.

7. Thermal spraying apparatus according to claim 3, wherein the throat comprises a tubular bore which is substantially surrounds the point of intersection of the two feedstock wire-like materials.

8. Thermal spraying apparatus according to claim 5, wherein the diameter of the throat is substantially constant along its length.

9. Thermal spraying apparatus according to claim 5, wherein the length of the throat is approximately equal to its diameter.

10. Thermal spraying apparatus according to claim 5, wherein the length of the throat is approximately equal to its diameter.

11. Thermal spraying apparatus according to claim 1, wherein the point of intersection is between a point located about midway along the length of the throat and the outer end of the throat.

12. Thermal spraying apparatus according to claim 2, wherein the point of intersection is between a point located about midway along the length of the throat and the outer end of the throat.

13. Thermal spraying apparatus according to claim 3, wherein the point of intersection is between a point located about midway along the length of the throat and the outer end of the throat.

14. Thermal spraying apparatus according to claim 5, wherein the point of intersection is between a point located about midway along the length of the throat and the outer end of the throat.

15. Thermal spraying apparatus according to claim 8, wherein the point of intersection is between a point located about midway along the length of the throat and the outer end of the throat.

16. Thermal spraying apparatus according to claim 11, wherein the nozzle defines a chamber inwardly of the throat, the chamber having an inner wall which has an average internal diameter several times greater than that of the throat and which tapers inwardly towards an inner end of the throat.

17. Thermal spraying apparatus according to claim 16, wherein the inner wall of the chamber joins the inner end of the throat at an angle of appoximately 45°.

* * * * *